United States Patent [19]

Tupper

[11] 4,165,816

[45] Aug. 28, 1979

[54] VENT CAP

[75] Inventor: Willis E. Tupper, Pinckney, Mich.

[73] Assignee: Dapco Industries, Dexter, Mich.

[21] Appl. No.: 894,921

[22] Filed: Apr. 10, 1978

[51] Int. Cl.[2] ..... B65D 51/16

[52] U.S. Cl. ..... 220/203; 220/303; 220/366; 220/373

[58] Field of Search ..... 220/373, 366, 303, DIG. 33, 220/203, 202, 304, 367; 137/493–499; 215/260

[56] References Cited

U.S. PATENT DOCUMENTS

| | | | |
|---|---|---|---|
| 1,724,346 | 8/1929 | Ford | 220/303 |
| 2,953,272 | 9/1960 | Mumford et al. | 215/260 |
| 3,043,463 | 7/1962 | Beall, Jr. | 215/260 |
| 3,144,154 | 8/1964 | Puse et al. | 215/260 |
| 3,174,641 | 3/1965 | Kitterman | 215/260 |
| 3,388,825 | 6/1968 | Miller | 220/203 |
| 3,825,147 | 7/1974 | Noponen | 220/366 |
| 3,861,557 | 1/1975 | Tupper | 220/373 |
| 3,913,781 | 10/1975 | Andreux | 220/203 |

*Primary Examiner*—Allan N. Shoap
*Attorney, Agent, or Firm*—Olsen and Stephenson

[57] ABSTRACT

A cap for a fuel tank such as is used with gasoline engines for chain saws, power mowers, snowmobiles, and the like, which require venting of the tank without danger of fuel leakage resulting from return flow through the vent passageway. The cap has an improved top wall assembly that provides the passageway that is utilized for the venting purposes and in which a check relief valve is housed.

6 Claims, 6 Drawing Figures

VENT CAP

BACKGROUND OF THE INVENTION

The present invention relates to vent closures for fuel tanks, and especially to improvements in vent caps of the type disclosed in U.S. Pat. No. 3,861,557, patented Jan. 21, 1975 in the name of Willis E. Tupper.

The vent cap disclosed in the aforesaid patent has proved to perform very satisfactorily in service, but there is still a continuing need to reduce even further the cost of manufacturing products of this character.

SUMMARY OF THE INVENTION

The present invention is an improvement over the vent cap disclosed in the cited U.S. Pat. No. 3,861,557, and provides a unique cap assembly whereby the vent passageway in the cap is formed between interconnected parts so that special drilling or molding techniques for forming the passageway are eliminated, thereby reducing further the cost of construction and simplifying the manufacturing operations associated with the cap.

According to one form of the present invention, a vent cap is provided which has a top wall assembly to which a peripheral flange is connected. The peripheral flange has internal threads for securing the vent cap to the threaded portion of a neck or spout of a fuel container. The top wall assembly includes a top panel member, a valve support member having a port extending through it. One side of the support member is positioned against the top panel member so that the members define between them a passageway extending from the port to the peripheral flange. A check relief valve element is mounted in the port with its one end in communication with the passageway and its other end adapted to be in communication with the interior of the fuel container. A sealing member is located on the other side of the support member adjacent to the periphery therof for seating on the upper edge of the neck or spout of the container when the vent cap is secured in place. The threads between the cap and the neck of the container provide a fluid leakage space so that the check relief valve element can provide pressure relief between the interior of the container and the ambient atmosphere via the passageway and the leakage space associated with the threaded connection.

In the preferred form of the invention, the top panel of the wall assembly is integrally formed with the peripheral flange, and the support member is fitted within the peripheral flange in seated relation with respect to the top panel member. In another form of the invention, the support member is integrally formed with the peripheral flange, and the top panel member is seated against the integrally formed structure and is secured thereto. In both forms of the invention, the passageway is defined between the top panel member and the support member so that when these members are assembled together, a radial passageway from the center port to the outer periphery of the members is formed merely as a result of these members being assembled together.

In the preferred form of the invention, the check relief valve element is an elastomeric construction of a known type having a duckbill portion which projects into the interior of the container when the cap is screwed in place on the neck thereof. Thus, a simplified low cost vent cap is provided which will perform to the high standards established by the vent cap disclosed in U.S. Pat. No. 3,861,557, and it can be formed at a lower cost.

Accordingly, it is one of the objects of the present invention to provide an improved vent cap for a fuel container.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENTS

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
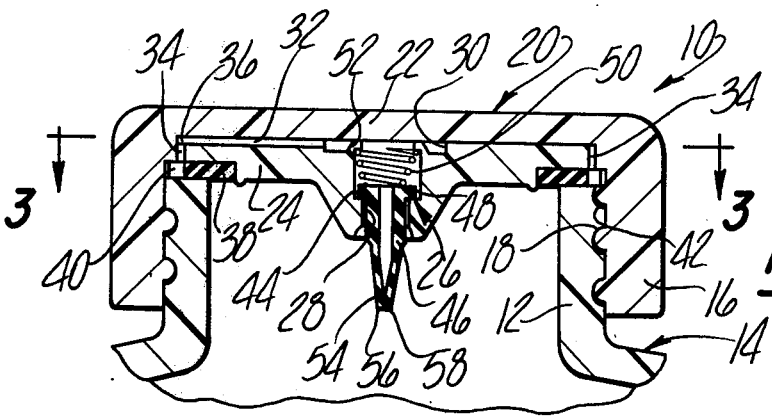
FIG. 1 is a vertical section through a vent cap embodying one form of the present invention and showing the vent cap mounted on the neck of the container which is fragmentarily shown.
Figure 2:
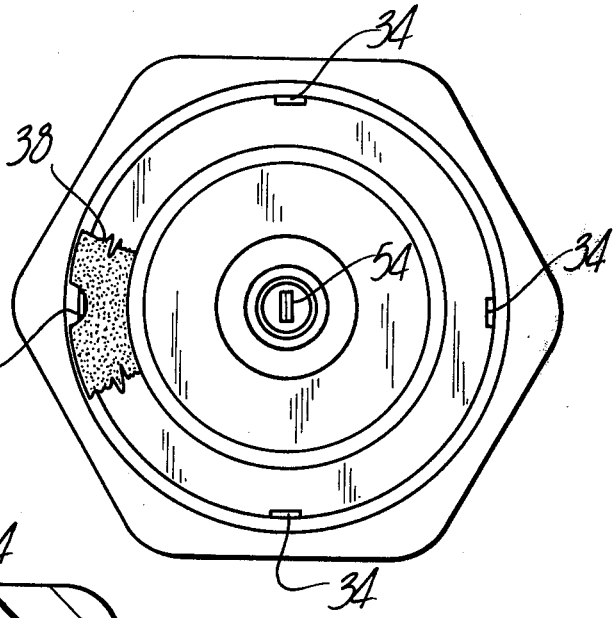
FIG. 2 is a bottom plan view of the vent cap with portions removed for illustration purposes.
Figure 3:
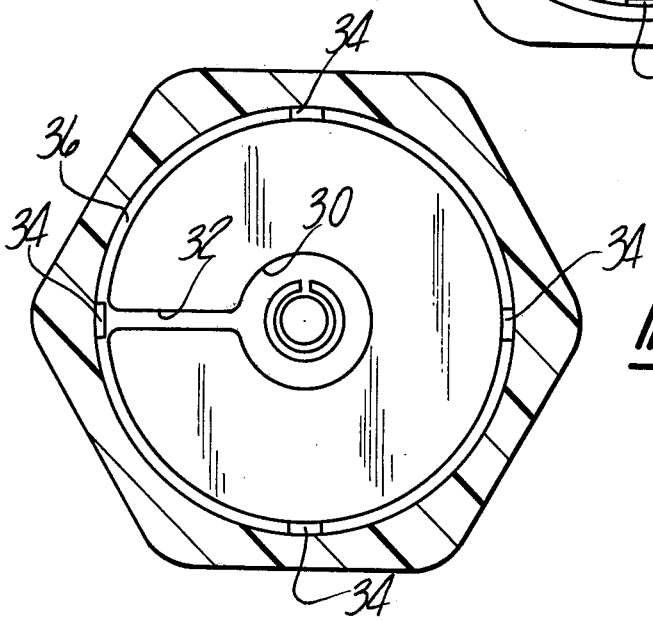
FIG. 3 is a vertical section taken on the lines 3—3 of FIG. 1.

Referring now to the drawings, the embodiment of the invention shown in FIGS. 1–3, inclusive, will first be described. The vent cap 10 is shown threadedly connected to the neck or spout 12 of the fuel container 14. The vent cap 10 has a peripheral flange 16 with internal fastening means 18 for attachment to the external periphery of the neck or spout 12, and in this instance, the internal fastening means are internal threads.

The vent cap 10 has a top wall assembly 20 which includes the top panel member 22, a valve support member 24, and a check relief valve element 26. The valve support member 24 has a port 28 extending axially through it for housing the check relief valve element 26. A cavity 30 is formed in the upper surface of the valve support member 24 and it is in communication with the radial groove 32. At the peripheral flange 16, a plurality of axial slots 34 are provided which are in communication with each other via the circumferential groove 36. A sealing member 38 is located on the under side of the support member 24 and preferably has a plurality of scallops in its edges, as at 40, so that a continuous passageway extends from the port 28 via the cavity 30, radial groove 32, circumferential groove 36, axial slots 34 to the top outer periphery of the container 12. At this location, fluid leakage spaces 42 are provided at the threads 18 so that the passageway and the fluid leakage spaces provide direct communication between port 28 and the ambient atmosphere.

The port 28 has a shoulder 44 on which the check relief valve element 26 is seated. The latter includes a resilient tubular body portion 46 which has at its upper end a peripheral shoulder 48 that is seated on the port shoulder 44 and is biased to this position by means of the spring 50 which is secured in place by means of the molded lip 52. The tubular body portion 46 extends through the port 28 and has a duckbill portion 54 which defines a pair of lips 56 and 58. If a pressure drop occurs within the container 14, air can pass from the outside of the container through the fluid leakage space 42 to the passageway defined between the members 22 and 24 to the port 28 and from there through the normally closed lips 56 and 58 into the container to equalize the pressure therein with respect to ambient pressure. If excessive pressure occurs within the container 14, when such excessive pressure reaches a preselected magnitude, it will act to urge the tubular body portion 46 upward off the seat formed by the shoulder 44, and the excess pressure can then be relieved around the outside of the portion 46 and through the passageway and fluid leakage space.

Figure 4:
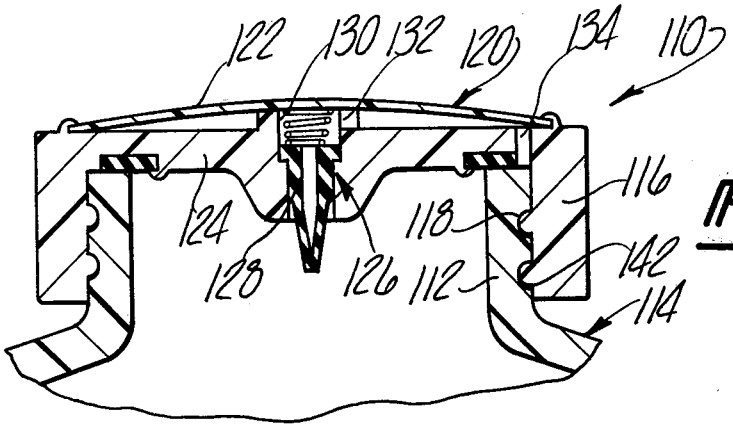
FIG. 4 is a vertical section similar to that of FIG. 1 of another embodiment of the invention.
Figure 5:
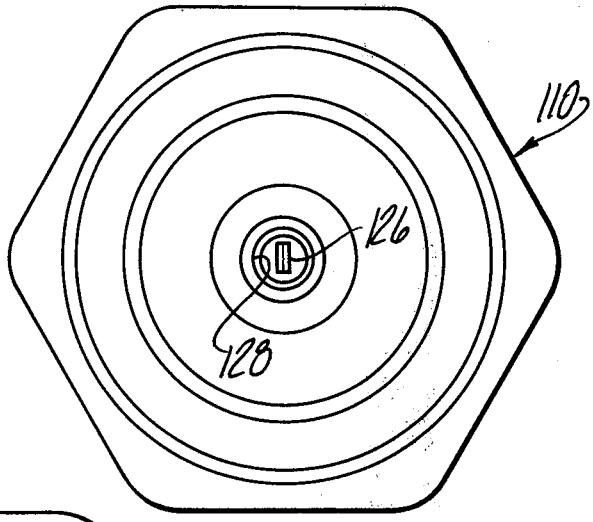
FIG. 5 is a bottom plan view of the vent cap illustrated in FIG. 4.
Figure 6:
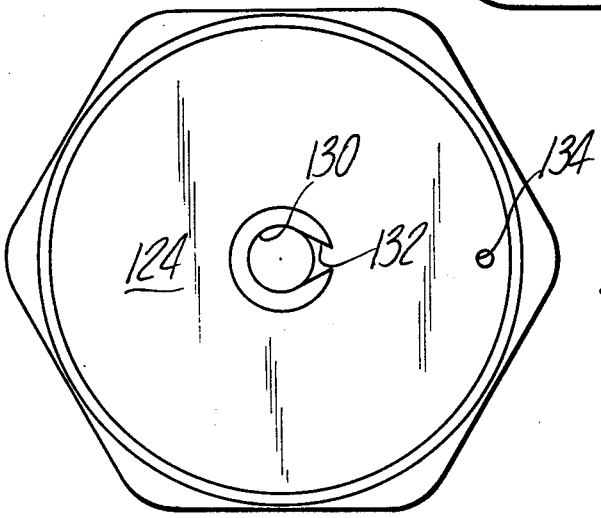
FIG. 6 is a top plan view of the vent cap illustrated in FIG. 4, but with the top panel member and spring biasing means removed for illustration purposes.

Referring now to FIGS. 4–6, inclusive, the embodiment in these figures of the drawing will be described. In this form of the invention, the vent cap 110 is also mounted on the neck or spout 112 of a container 114. It also has a peripheral flange 116 which has internal fastening means 118, which again are internal threads. A top wall assembly 120 is provided which is connected to the peripheral flange 116. In this form of the invention, a top panel member 122 is separately formed and then is connected to the integral structure which includes the valve support member 124 and the peripheral flange 116. The check relief valve element 126 is housed in the port 128 which extends through the valve support member 124. Again, a cavity 130 is formed in the top surface of the valve support member 124 and an outlet is provided at 132 for communication with the duct 134. Thus, a passageway is defined between the port 130 and the peripheral flange 116 in essentially the same manner as was done with respect to the embodiment in FIGS. 1–3. Also, this passageway is in communication with the fluid leakage space 142 defined at the threaded connections between the peripheral flange 116 and the neck of the container 112. The operation of the check relief valve element 126 is the same as the corresponding valve element 26 described with respect to the embodiment in FIGS. 1–3, and the operation will not be described again.

It is claimed:

1. A vent cap for a fuel container, comprising a top wall assembly, and a peripheral flange connected to the top wall assembly, and having internal fastening means for attachment to the external periphery of the neck or spout of a fuel container, said top wall assembly including a top panel member, a valve support member having a port extending therethrough from one side to the other, the one side of said support member being in juxtaposition with said top panel member so that said top panel member and said support member define between them a passageway extending from said port to said pheripheral flange, and a check relief valve element mounted in said port with its one end in communication with said passageway and its other end adapted to be in communication with the interior of the fuel container, and a sealing member located on the other side of said support member adjacent to the periphery thereof for seating on the top of said neck or spout and clamped between the support member and the top of said neck or spout when the vent cap is secured to the fuel container, said support member and said sealing member cooperating with said peripheral flange to define a leakage space around the outer peripheries of the support member and sealing member, said internal fastening means providing fluid leakage space so that said check relief valve element can provide pressure relief between the interior of the container and the ambient atmosphere via said passageway and the leakage spaces associated with said internal fastening means and said sealing member.

2. The vent cap that is defined in claim 1, wherein one of said top panel and said support members is integrally formed with said peripheral flange and the other of said members is attached thereto.

3. The vent cap that is defined in claim 2, wherein said top panel member is integrally formed with said peripheral flange, and said support member is fitted within said peripheral flange and seated against said top panel member.

4. The vent cap that is defined in claim 2, wherein said support member is integrally formed with said peripheral flange, and said panel member is seated against the integrally formed structure and is secured thereto.

5. The vent cap that is defined in claim 1, wherein said check relief valve element has a tubular body portion with a peripheral shoulder that is seated in sealing relation with one edge of said port and a duckbill portion extending from the tubular portion for communication with the interior of the tank, and biasing means urging said valve element to the seated position of its peripheral shoulder and responsive to a pressure above a preselected magnitude to unseat the peripheral shoulder to release excessive pressure from within said tank around said relief valve and through said passageway and said leakage space, said duckbill portion having lips adapted to part to allow pressure release in a reverse direction when the pressure within said tank drops below a preselected magnitude.

6. The vent cap that is defined in claim 1, wherein said internal fastening means are threads formed on the inner wall of said peripheral flange.

* * * * *